United States Patent [19]

Mitchell et al.

[11] Patent Number: 4,709,517

[45] Date of Patent: Dec. 1, 1987

[54] FLOOR-TO-CEILING WALL SYSTEM

[75] Inventors: Terry L. Mitchell; Robert J. Poortvliet, both of Jenison, Mich.

[73] Assignee: Architectural Wall Systems, Inc., Grand Rapids, Mich.

[21] Appl. No.: 869,439

[22] Filed: Jun. 2, 1986

[51] Int. Cl.[4] ..... A47B 5/00

[52] U.S. Cl. ..... 52/36; 52/243.1; 52/145; 52/730

[58] Field of Search ..... 52/36, 145, 126.4, 730, 52/213, 243.1; 248/243; 403/187

[56] References Cited

U.S. PATENT DOCUMENTS

| | | | |
|---|---|---|---|
| 1,193,575 | 8/1916 | McFarland . | |
| 1,694,690 | 12/1928 | Reinhold . | |
| 2,055,442 | 9/1936 | Jones . | |
| 2,129,432 | 9/1938 | Lipp | 403/187 |
| 2,325,766 | 8/1943 | Gisondi . | |
| 2,766,855 | 10/1956 | Johnson . | |
| 2,768,410 | 10/1956 | Woodard . | |
| 2,796,158 | 6/1957 | Miles . | |
| 2,968,374 | 1/1961 | Bohnsack . | |
| 3,093,218 | 6/1963 | Peterson . | |
| 3,136,530 | 6/1964 | Case | 403/246 |
| 3,180,457 | 4/1965 | Bohnsack . | |
| 3,191,727 | 6/1965 | Schmeltz . | |
| 3,205,630 | 9/1965 | Felix . | |
| 3,305,981 | 2/1967 | Biggs et al. | 52/36 |
| 3,339,954 | 9/1967 | Alvden . | |
| 3,358,411 | 12/1967 | Birum . | |
| 3,395,504 | 8/1968 | Zwickert . | |
| 3,451,183 | 6/1969 | Lespagnol . | |
| 3,482,706 | 12/1969 | Stewart . | |
| 3,508,364 | 4/1970 | Thompson | 52/126.4 |
| 3,545,152 | 12/1970 | Knohl | 52/730 |
| 3,596,405 | 8/1971 | Ingulf | 52/213 |
| 3,619,960 | 11/1971 | Thompson . | |
| 3,621,635 | 11/1971 | De Lange . | |
| 3,631,647 | 1/1972 | Merkin . | |
| 3,638,387 | 2/1972 | Lickliter . | |
| 3,680,271 | 8/1972 | Satchell . | |
| 3,714,748 | 2/1973 | Costruba | 52/36 |
| 3,724,150 | 4/1973 | Hudnall . | |
| 3,733,756 | 5/1973 | Butler . | |
| 3,745,708 | 7/1973 | Gulistan . | |
| 3,755,979 | 9/1973 | Pantazi . | |
| 3,830,027 | 8/1974 | Paisley . | |
| 3,831,328 | 8/1974 | Mohr | 52/145 |
| 3,837,128 | 9/1974 | O'Brien . | |
| 3,845,601 | 11/1974 | Kostecky . | |
| 3,846,944 | 11/1974 | Lambert | 248/243 |
| 3,948,011 | 4/1976 | Price . | |
| 3,952,462 | 4/1976 | Heise . | |
| 3,983,670 | 10/1976 | Lightfoot . | |
| 3,990,205 | 11/1976 | Davis . | |

(List continued on next page.)

FOREIGN PATENT DOCUMENTS

| | | | |
|---|---|---|---|
| 54872 | 10/1974 | Australia . | |
| 253177 | 3/1967 | Austria . | |
| 73779 | 4/1976 | Austria | 403/187 |
| 2510949 | 9/1967 | Fed. Rep. of Germany . | |
| 2036962 | 3/1972 | Fed. Rep. of Germany . | |
| 2238020 | 3/1973 | France . | |
| 7900373 | 7/1980 | Netherlands . | |
| 580623 | 9/1946 | United Kingdom . | |
| 2070100 | 9/1981 | United Kingdom . | |

*Primary Examiner*—Henry E. Raduazo
*Attorney, Agent, or Firm*—Price, Heneveld, Cooper, Dewitt & Litton

[57] ABSTRACT

A floor-to-ceiling wall system having telescoping studs that extend between a ceiling bracket and a floor leveler assembly. The floor leveler assembly includes a leveling channel that is adjusted in order to level an entire wall. During assembly, a first telescoping stud is secured between the ceiling channel and floor leveler assembly and vertically aligned. Thereafter, subsequent studs are automatically aligned by the securing of horizontal stringers sequentially between the telescoping studs. Door jams and window frames are secured to the studs, and wall panels are hung from the horizontal stringers. Adapter brackets hung from the vertical studs accommodate wall accessories with various mounting hook patterns in order to adapt the wall system to a wide variety of wall accessories.

20 Claims, 27 Drawing Figures

U.S. PATENT DOCUMENTS

| | | | |
|---|---|---|---|
| 4,034,535 | 7/1977 | Dustmann . | |
| 4,037,380 | 7/1977 | Pollock . | |
| 4,041,667 | 8/1977 | Lindner . | |
| 4,103,463 | 8/1978 | Dixon . | |
| 4,120,124 | 10/1978 | Temple . | |
| 4,146,140 | 3/1979 | Suter | 248/243 |
| 4,150,753 | 4/1979 | Stahl | 248/251 |
| 4,219,175 | 8/1980 | Harig | 248/243 |
| 4,245,442 | 1/1981 | Durham . | |
| 4,287,698 | 9/1981 | Baus . | |
| 4,356,672 | 11/1982 | Beckman . | |
| 4,458,462 | 7/1984 | Schold . | |
| 4,460,147 | 7/1984 | Macbain | 248/243 |
| 4,515,494 | 5/1985 | Robilliard | 248/243 |
| 4,550,893 | 11/1985 | Wiersema | 248/243 |
| 4,591,287 | 5/1986 | Haghes | 403/246 |

FIG. 5
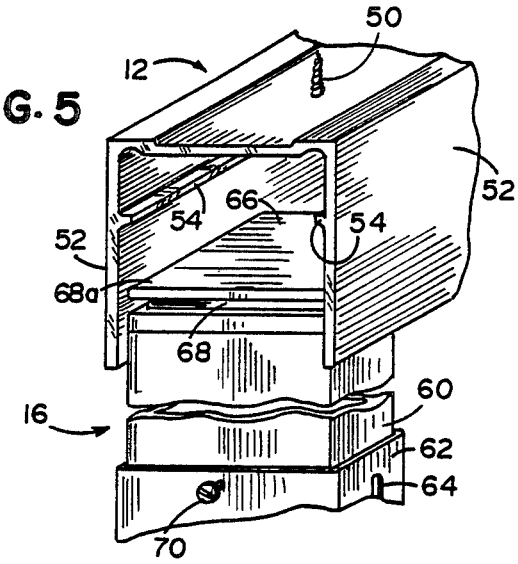
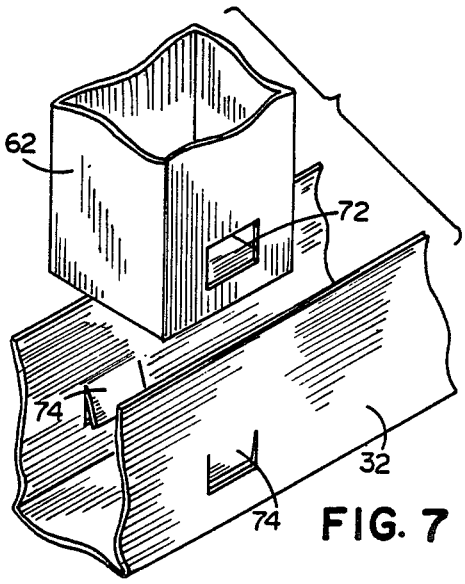
FIG. 7
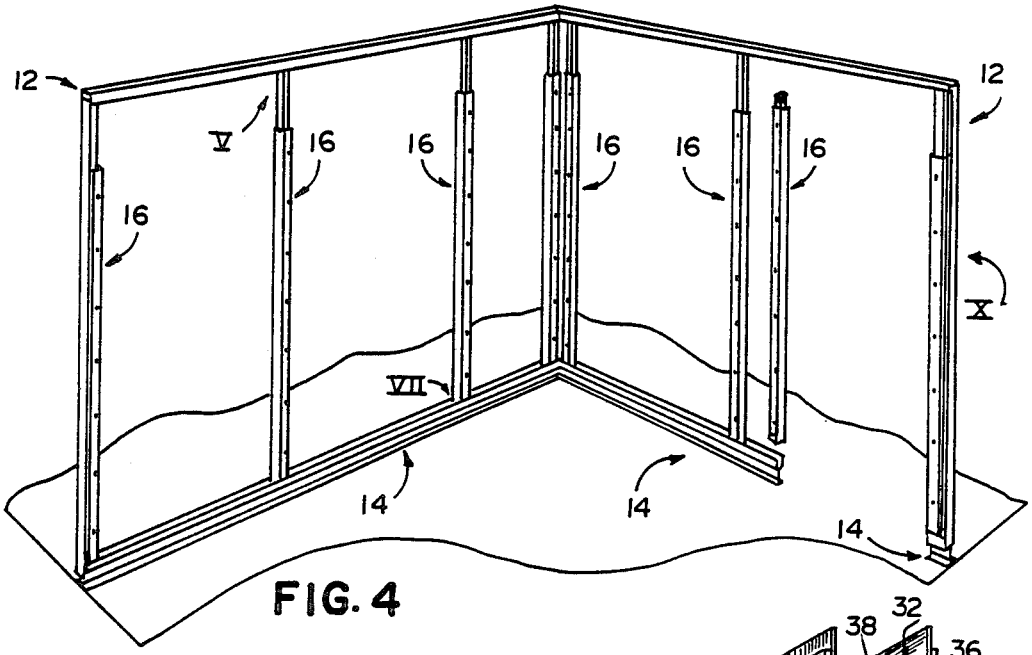
FIG. 4
FIG. 6
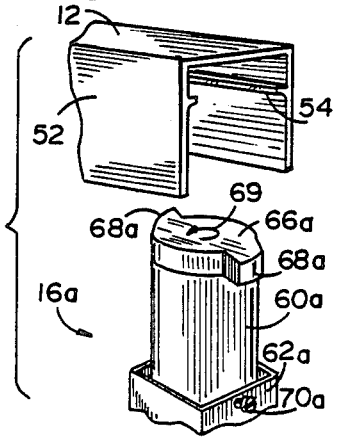
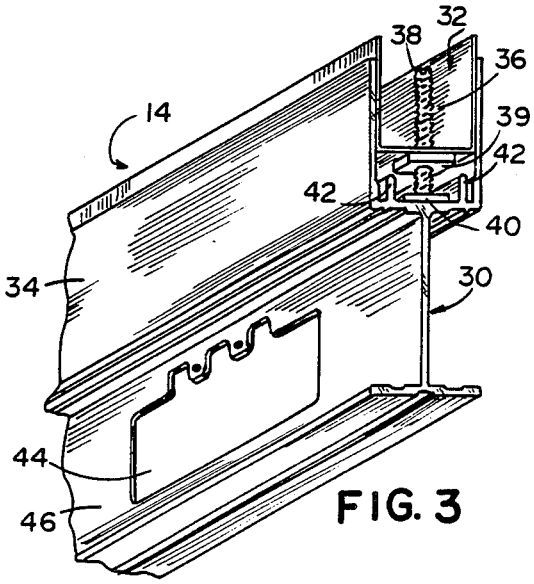
FIG. 3

FIG. 22
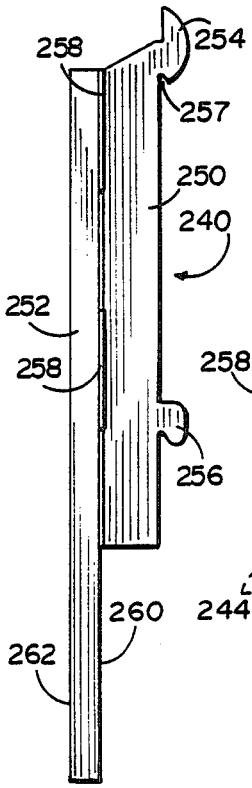
FIG. 23
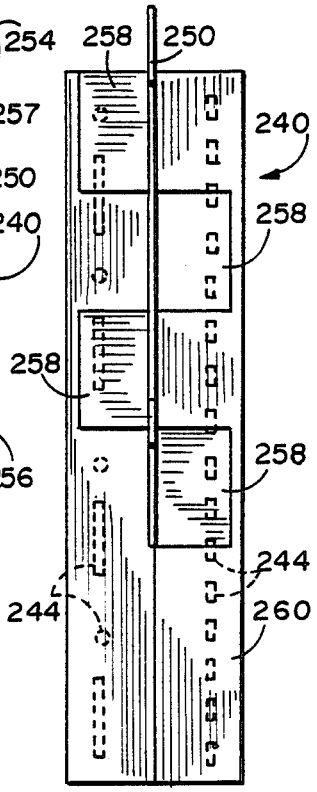
FIG. 20
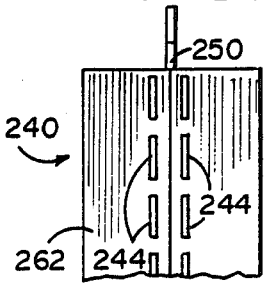
FIG. 24
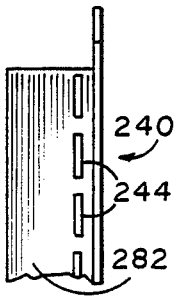
FIG. 21
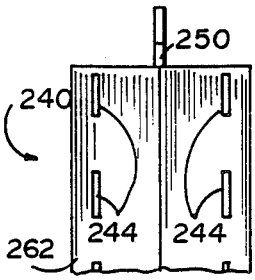
FIG. 25
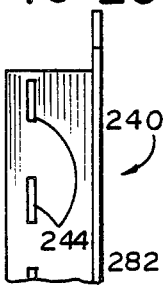
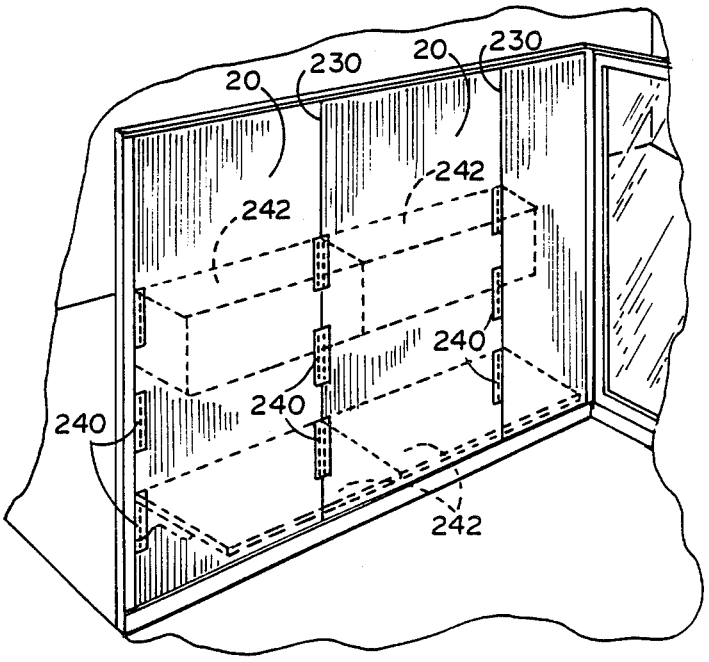
FIG. 19
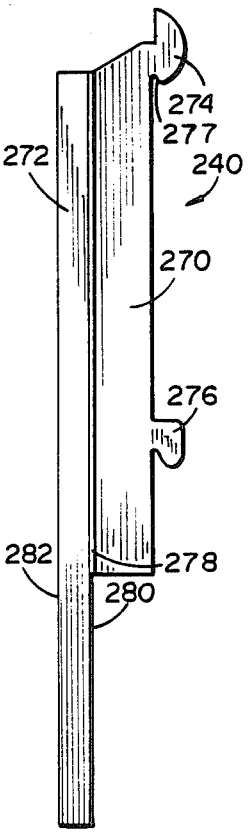
FIG. 26
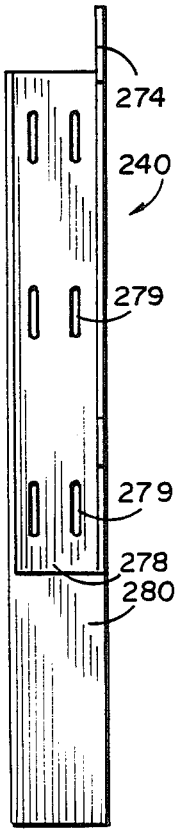
FIG. 27

FLOOR-TO-CEILING WALL SYSTEM

BACKGROUND OF THE INVENTION

The present invention relates to room partition systems, and more particularly to wall systems that extend from the floor to the ceiling.

Typically a floor-to-ceiling wall partition system includes a series of wall panels that are secured in some manner to both the floor and ceiling, and are secured to adjacent wall panels. In some systems the wall panels are hung from a series of vertical studs that are supported between the floor surface and ceiling. Since this type of wall partition is often later added to existing and older buildings, the vertical studs must each be levelled in order to accommodate the variation in floor-to-ceiling spacing that results from settling of the building. Typically to level the wall partition either each individual stud or each individual wall panel must be separately levelled to accommodate this spacing variation. Although the individual levelling of each panel assembly maintains the alignment of accessory mounting brackets and the like on any given wall panel, this individual levelling does not maintain the alignment between accessory mounting brackets on adjacent panels. Further, the individual alignment of each panel assembly or each vertical stud can be a time consuming process that greatly increases the assembly time for the partition wall.

Additionally, in floor-to-ceiling wall systems that utilize vertical studs as support members, each stud must be vertically aligned in order to permit proper hanging and support of the wall panels. Again, the vertical alignment of each individual stud can be a time consuming and tedious process. This time required for alignment of each vertical stud is increased even more in wall systems in which the adjustment of the vertical alignment for one stud also requires adjustment to the levelling of the stud. The variation common to older buildings in vertical alignment of structural walls against which the partitioning wall is erected further complicates the task of trueing the wall partition.

Another common feature of many wall systems is the provision of slotted wall standards or brackets that are used to hang wall accessories such as cupboards, shelves or the like. One problem associated with the use of such wall mounted accessories is the use by different accessory manufacturers of different spacings or patterns for the mounting hooks on the accessories. The wall mount accessory will therefor only mate with a wall partition of that manufacturer and cannot be used with other wall systems manufactured by other companies. This reduces the variety of wall accessory units that may be used with any given wall system.

SUMMARY OF THE INVENTION

The present invention provides a floor-to-ceiling wall system that may be readily installed with a reduced number of levelling or aligning steps. The wall system includes a series of generally vertical studs that extend between a ceiling channel and a floor channel. The first of the series of studs is vertically aligned, and thereafter the successive vertical studs are sequentially aligned by the securing of horizontal stringers between the first vertical stud and the next successive stud, and so continuing down the line of studs. In a preferred embodiment, the vertical studs telescope to permit adjustment of the heighth of the stud as the process of sequential stringer positioning automatically vertically trues the studs.

Other aspects of the invention include a levelling assembly that levels an entire wall with a single levelling adjustment, window frames, door jams and stringers that each include key holes which receive mounting projections on the vertical studs, and adapter mounting brackets that are used to hang wall accessories from the vertical studs. The adapter brackets have hooks that are spaced to mate with slots in the vertical studs. Different sets of adapter brackets are provided with mounting apertures that are spaced and configured to accommodate the hook spacing used by the particular accessory manufacturer of the mounting hooks on the wall accessory.

These and various other features, objects and aspects of the invention will be recognized by one skilled in the art from the description and claims which follow and the drawings appended hereto.

BRIEF DESCRIPTION OF THE DRAWINGS

FIG. 3 is a fragmentary, perspective view of the floor leveler assembly of FIG. 2, taken in the region of arrow III in FIG. 2;

FIG. 4 is a perspective view of the vertical studs using the system of FIG. 1, shown being assembled onto the ceiling channel and floor leveler assembly;

FIG. 5 is a fragmentary, perspective view of the upper end of one of the vertical studs being assembled onto the ceiling channel, taken in the region of arrow V in FIG. 4;

FIG. 6 is a fragmentary, perspective view of a vertical stud forming an alternative embodiment of the invention being assembled onto the ceiling bracket;

FIG. 7 is a fragmentary, perspective view of the lower end of a vertical stud being assembled onto the floor leveler assembly, taken in the region of arrow VII in FIG. 4;

FIG. 19 is a fragmentary, perspective view of wall accessories shown in phantom hung on the wall system of FIG. 1;

FIG. 20 is a fragmentary, front elevational view of a two sided adapter bracket for hanging wall accessories of the system shown in FIG. 1;

FIG. 21 is a fragmentary, front elevational view of an alternative two sided adapter bracket;

FIG. 22 is a side elevational view of another alternative two sided, adapter bracket;

FIG. 23 is a rear elevational view of the two sided adapter bracket of FIG. 22;

FIG. 24 is a fragmentary, front elevational view of a one sided adapter bracket for hanging wall accessories of the system shown in FIG. 1;

FIG. 25 is a fragmentary, front elevational view of an alternative one sided adapter bracket;

FIG. 26 is a side elevational view of another alternative one sided adapter bracket; and FIG. 27 is a rear elevational view of the one sided adapter bracket shown in FIG. 26.

DETAILED DESCRIPTION OF THE PREFERRED EMBODIMENTS

Figure 1:
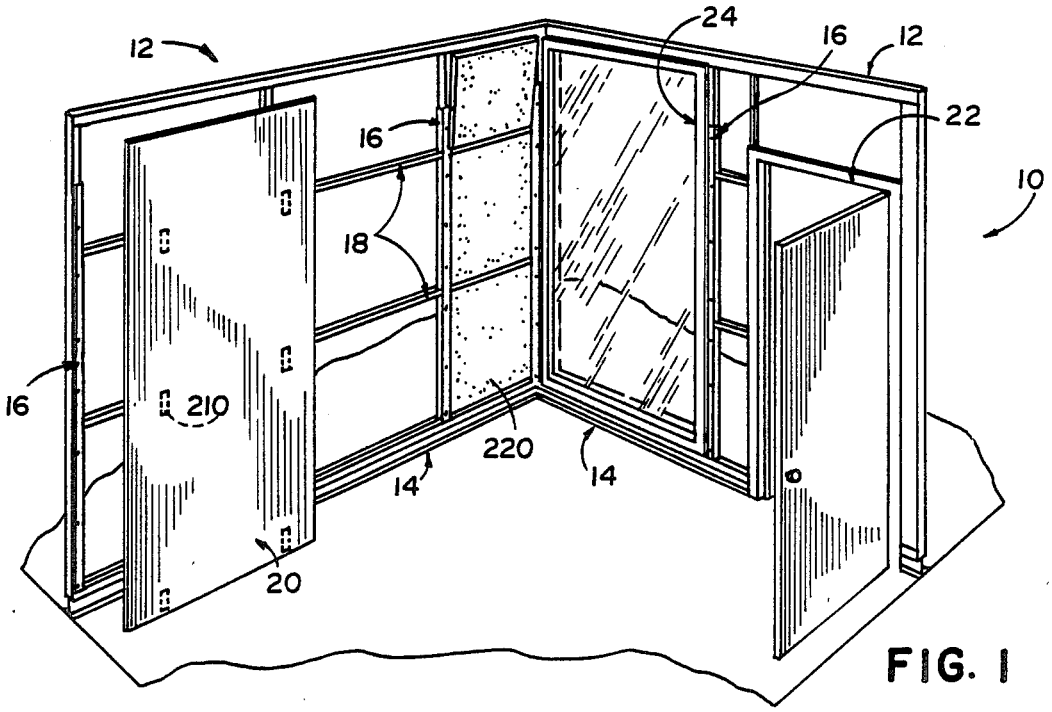
FIG. 1 is a perspective, exploded view of the wall system embodying the invention, showing the system in partially assembled, condition.

The present invention is embodied in a floor-to-ceiling wall system shown in preferred form in FIG. 1 and referenced generally by the number 10. The wall system 10 includes a ceiling channel 12 and a floor leveler channel or assembly 14. A series of telescoping vertical studs 16 extend between ceiling bracket 12 and floor leveler assembly 14. A set of generally horizontal stringers 18 span between adjacent vertical studs 16, while wall panels 20 are hung from stringers 18. A door jam 22 is mounted between adjacent vertical studs 16, and a window frame 24 is mounted between another set of adjacent vertical studs 16.

During assembly of wall system 10, one entire wall is levelled simultaneously by the adjustment of floor leveler assembly 14. A first vertical stud 16 is supported between the ceiling channel and the floor leveler assembly, and this first stud 16 is vertically aligned and secured in place. Thereafter the next adjacent stud 16 is positioned between ceiling channel 12 and floor leveler assembly 14, and a set of stringers 18 are secured between the first vertical stud 16 and the next successive stud 16. The securing of stringers 18 aligns the adjacent studs 16, and the remaining successive vertical studs 16 are aligned by the sequential placement of stringers 18 between successive vertical studs 16.

Figure 2:
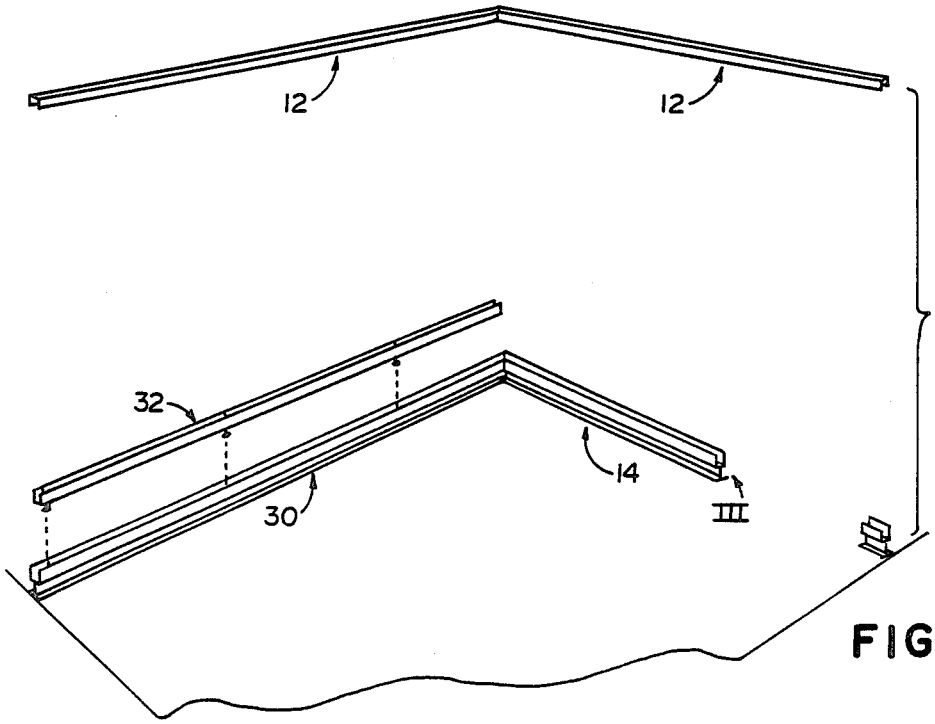
FIG. 2 is a perspective, exploded view of the ceiling channel and floor leveler assembly used in the system shown in FIG. 1.

Initially, as shown in FIG. 2 ceiling channel 12 is secured along the structural ceiling and floor leveler assembly 14 is positioned on the floor surface generally aligned beneath ceiling channel 12. As shown in FIG. 2, ceiling channel 12 and floor leveler assembly 14 are positioned to partition off a corner area of a work space and therefore two sets of ceiling channels 12 and floor leveler assemblies 14 extend at right angles between two corner structural walls. Although a single set of elements for wall system 10 are described, wall system 10 may be used to provide a single wall, a four walled enclosure or any other combination required for a given work environment.

Floor leveler assembly 14 includes a floor track or runner 30 (FIG. 3) and a leveler channel 32. The base of floor runner 30 has a generally "I" beam construction that spaces a raised upper channel 34 above the floor surface. Upper channel 34 is a generally rectangular, upwardly opening "U" shaped channel in which leveler channel 32 is received. Floor runner 30, including its base portion and upper channel 34, is extruded as a single piece. Leveler channel 32 is an elongated, upwardly opening "U" shaped bracket that closely nests in upper channel 34. A series of adjustment bolts 36 are spaced along leveler channel 32 and extend between leveler channel 32 and upper channel 34. Each adjustment bolt 36 has a slotted upper end 38 that permits a screwdriver to be inserted for the adjustment of bolt 36. Adjustment bolts 36 are threaded through a Tinnerman TM nut 39 and the undersurface of leveler bracket 32, and the heads 40 of bolts 36 rotatably abut upper channel 34 so that the adjustment of bolts 36 raises or lowers leveler channel 32 relative to floor runner 30.

Floor leveler assembly 14 is horizontally levelled by setting to a predetermined heighth the adjustment bolt 36 at one end of leveler channel 32 and then adjusting the bolt 36 at the opposite end of leveler channel 32. The remaining intermediate adjustment bolts 36 are lowered until bolt heads 40 contact upper channel 34 in order to provide additional support for leveler channel 32 along its length As shown in FIG. 3, protruding from the lower surface of upper channel 34 are two seating flanges 42 that provide a lower stop for leveler bracket 32. Bolt heads 40 are seated between seating flanges 42. Also shown in FIG. 3, upper channel 34 is raised above the floor surface in order to provide wire ways running along the base of floor runner 30. Molding covers 43 (FIG. 17) are snapped into floor runner 30 beneath upper channel 34 to close and mask the wire ways. Electrical outlet mounting apertures 44 (FIG. 3) are knocked out from lower webbing 46 in order to permit the placement of electrical outlet boxes or other circuitry at selected locations along floor leveler assembly 14. Upper channel 34 is raised above the floor surface so that electrical conduit and the like may extend along floor runner 30 without interfering with the levelling mechanism or other various elements that are mounted on leveler assembly 14.

As shown in FIG. 5, ceiling channel 12 is a rectangular, inverted "U" shaped bracket that is secured to the ceiling by screws 50 or other suitable conventional fasteners. Ceiling channel 12 includes two depending side walls 52 that are spaced to slidably receive the upper ends of telescoping studs 16. Projecting inwardly along the length of both sidewalls 52 are lips 54 that are used to secure the upper ends of telescoping studs 16.

As shown in FIG. 4, a series of telescoping studs 16 are roughly positioned between ceiling channel 12 and floor leveler assembly 14. As shown in FIG. 5, each telescoping stud 16 includes a rectangular upper post 60 that is telescopingly received in a lower base section 62. Vertically spaced along base section 62 are a series of accessory hanging slots 64 that are used to mount wall hanging accessories as described more fully below. Connected to upper end of upper post 60 is an extruded vinyl coupling element 66. Coupling element 66 includes an annular groove 68 that is configured to mate with lips 54 on ceiling channel 12 leaving a projecting upper portion 68*a* seated on top of lips 54 to suspend the upper portion 60 of stud 16 therefrom. Coupling element 66 is sufficiently resilient that upper post 60 is raised until coupling 66 contacts and then snaps over lips 54. Upper post 60 therefore hangs freely from ceiling channel 12. A set screw 70 at the top of base section 62 frictionally locks upper post 60 and base section 62 together once stud 16 has been vertically aligned. A circular or rectangular post 71 of compressible foam material is slid down into each telescoping stud 16 to extend along at least lower base section 62 in order to block light and reduce sound from passing through slots 64. Post 71 compresses when hooks are inserted into slots 64.

As shown in FIG. 7, the lower end of base section 62 is slidably seated in leveler channel 32. The lower end of base section 62 includes a set of rectangular apertures 72 that mate with indented tabs or tangs 74 on the sides of leveler channel 32. During assembly base section 62 is snapped into place over tab 74 in order to roughly position telescoping studs 16 at predetermined intervals along floor leveler assembly 14. As shown in FIG. 4, telescoping studs 16 are each first seated in leveler channel 32 over one positioned tab 74, and upper post 60 is then raised until coupling element 66 is seated in ceiling channel 12. The first telescoping stud 16 in the series of studs 16 is vertically aligned. The first stud 16 may be accurately aligned using a level, plumb bob, or the like, or in some installations visual alignment of the first telescoping stud 16 may be sufficient. Once aligned, set screw 70 is tightened in order to fix the length of telescoping stud 16. The fixed length of telescoping stud 16 resists the lateral movement of upper post 60 along ceiling channel 12, as does the frictional resistance provided by coupling element 66 itself. Leveler channel 32 may also be provided without tabs 74, so that telescoping studs 16 may be seated anywhere along the length of channel 32. Friction between the sides of channel 32 and studs 16 maintain studs 16 in position.

Alternatively, upper post 60 may be provided with an extruded vinyl coupling element that provides some degree of compressive resilience, but which does not snap over and hang from lips 54. In this alternative embodiment, the first telescoping stud 16 is vertically aligned, and upper post 60 is then raised until coupling element 66 abuts and is compressed against lips 54. When so positioned, such screw 70 is then tightened in order to maintain telescoping stud 16 in this clamped position between ceiling bracket 12 and floor leveler assembly 14. This abutment of coupling element 66 against lips 54 resists the lateral movement of upper post 60 along ceiling bracket 12.

Another alternative preferred embodiment is shown in FIG. 6. A telescoping stud 16*a* includes a cylindrical upper post 60*a* that telescopes into a rectangular base section 62*a*. On the upper end of upper post 60*a* is a coupling element 66*a* that is used to hang upper post 60*a* from lips 54 on ceiling channel 12. Projecting from opposite sides of coupling element 66*a* are curved tabs 68*a*. When upper post 60 is rotated so that tabs 68*a* are aligned parallel to lips 54, upper post 60 is raised until coupling in the direction of arrow 69 until locking tabs 68*a* are seated on top of lips 54. In this position, stud 16*a* can be moved at its top and upper portion 60*a* will remain suspended from lips 54. To secure stud 16*a*, upper post 60*a* is rotated further until the engagement of locking tabs 68*a* with side panels 52 resists lateral movement of post 60 along ceiling bracket 12. Set screw 70*a* may be tightened to further clamp telescoping studs 16*a* in position.

Figure 8:
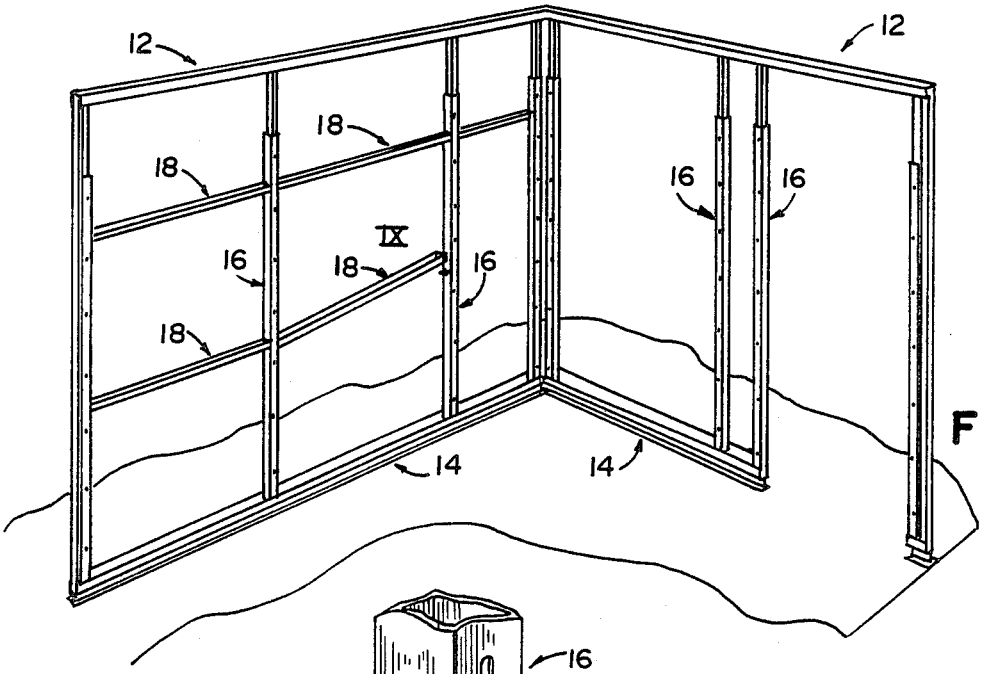
FIG. 8 is a perspective view of horizontal stringers used in the system of FIG. 1 shown being assembled onto the vertical studs.

As shown in FIG. 8, horizontal stringers 18 are secured between adjacent telescoping studs 16. Starting from the initial telescoping stud 16 that had been vertically aligned, a set of stringers 18 are secured between the aligned studs 16 and the next successive stud 16. The placement of stringers 18 automatically aligns the next successive telescoping stud 16. This sequence is followed down along the series of telescoping studs 16, so that the positioning of stringers 18 sequentially aligns each telescoping stud 16 automatically without requiring the assembler to align the individual studs 16 by conventional methods.

Figure 9:
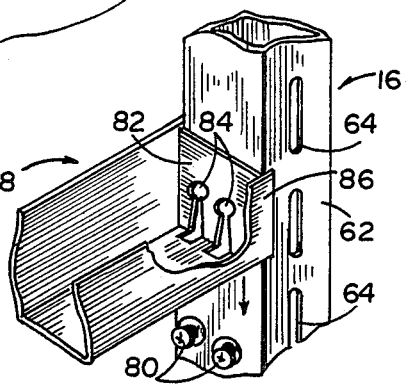
FIG. 9 is a fragmentary, perspective view of the end of a horizontal stringer being assembled onto a vertical stud, taken in the region of arrow IX in FIG. 8.

As shown in FIG. 9, stringers 18 are secured to lower section 62 of studs 16. Each lower section 62 includes two laterally spaced shoulder screws 80 set at predetermined heights along the length of lower section 62. Stringer 18 has a generally rectangular, upwardly opening U-shaped cross section, with a mounting tab 82 bent up at each end. Mounting tab 82 includes two keyhole slots 84 that widen and open out through the bottom of stringer 18. Keyhole slots 84 are spaced and configured to receive shoulder screws 80 with a snap-seating action and thereby rigidly join adjacent studs 16. The sidewalls of stringers 18 extend past mounting tab 82 to form two projecting alignment tabs 86 on both ends of each stringer 18. Alignment tabs 86 project slightly past the sides of telescoping studs 16 and slidably abut lower section 62 in order to form a shallow pocket in which lower section 62 is snugly received. Alignment tabs 86 provide additional rigidity to the joint formed between stringer 18 and studs 16. As shown in FIG. 8, a set of two stringers 18 are secured between each adjacent pair of studs 16 in order to square up the next successive telescoping stud 16.

Figure 10:
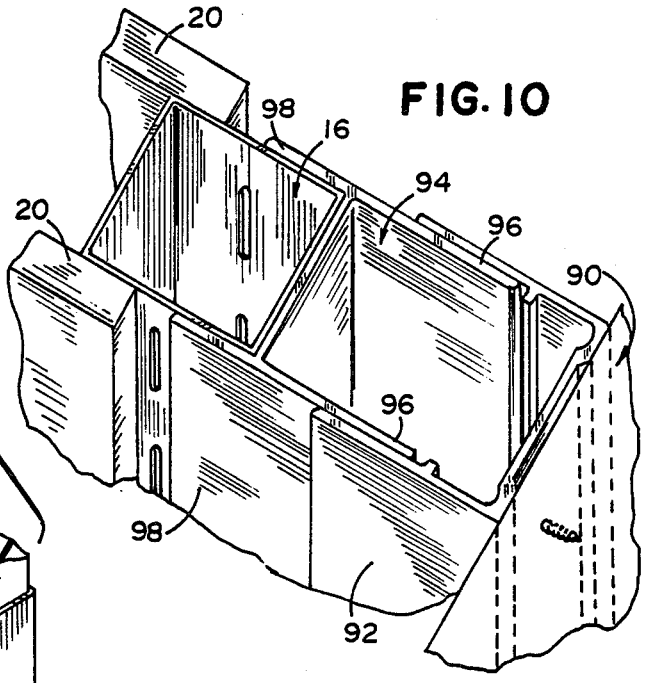
FIG. 10 is a fragmentary, perspective view of a vertical stud adjacent a structural wall, shown with a wall abutment assembly extending between the structural wall and the vertical stud, taken in the region of arrow X in FIG. 4.

Shown in FIG. 10 is an adapter assembly that accommodates variations in the vertical alignment of structural walls against which wall system 10 abuts, and accommodates gaps between standard wall lengths and the walls from which they project. This eliminates the need to piece in a small section of wall. A telescoping stud 16 is positioned closely adjacent a structural wall 90. A sidewardly opening, rectangular, U-shaped wall bracket 92 is secured to structural wall 90 by suitable conventional fasteners. An adapter element 94 has a generally "H" shaped cross section and mates with wall bracket 92. Adapter element 94 extends the height of wall system 10 between ceiling channel 12 and floor leveler assembly 14. One set of legs 96 on adapter element 94 are slidably received in wall bracket 92. The other set of legs 98 form a pocket that frictionally seats telescoping studs 16. Legs 98 are sufficiently wide to accommodate fluctuation in vertical alignment of structural wall 90, thereby providing overlap between legs 96 and wall bracket 92. Alternatively, if the gap between wall panel 10 and structural wall 90 is sufficiently small, telescoping studs 16 may be seated within wall bracket 92 directly without the use of an intervening adapter element 94. Wall bracket 92 will therefore close the gap between structural wall 90 and studs 16.

Figure 11:
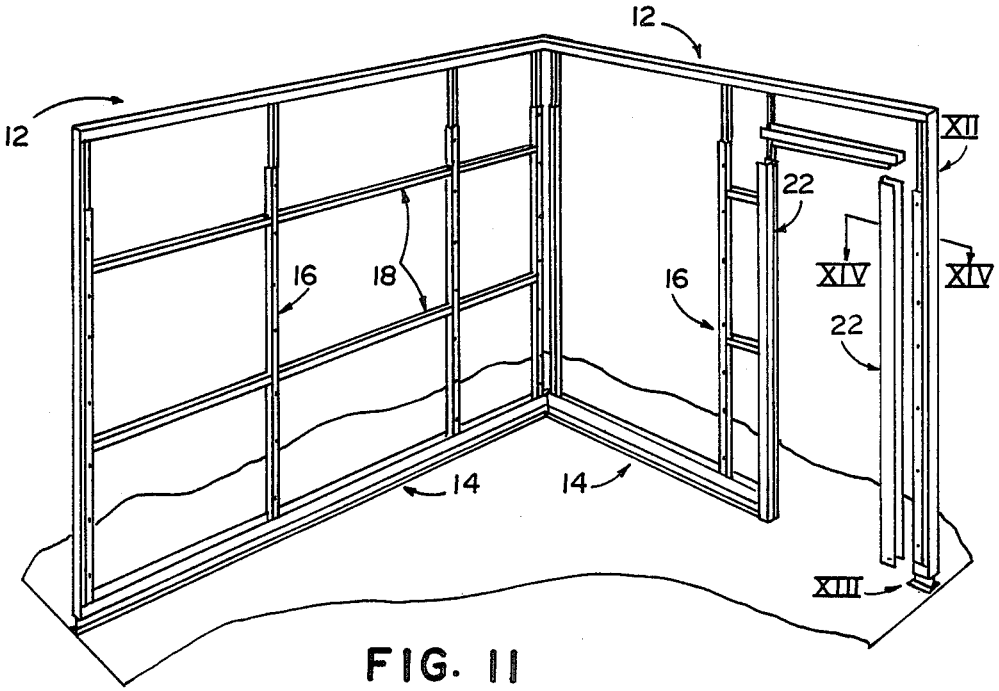
FIG. 11 is a perspective view of a door jam of the wall system of FIG. 1, shown being assembled onto the vertical studs.
Figure 12:
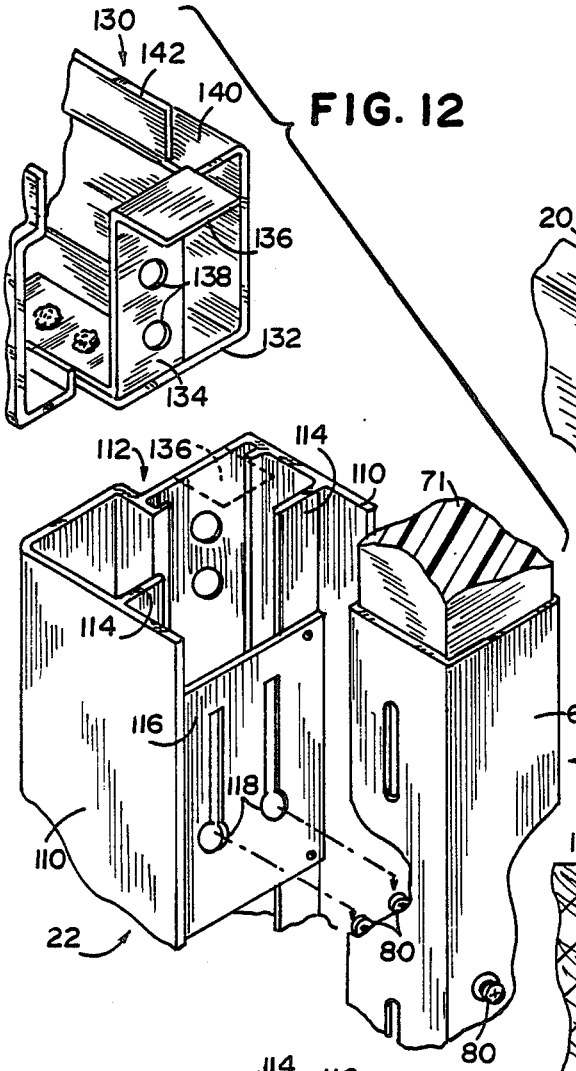
FIG. 12 is a fragmentary, perspective exploded view of the door jam-vertical stud assembly, taken in the region of arrow XII of FIG. 11.
Figure 13:
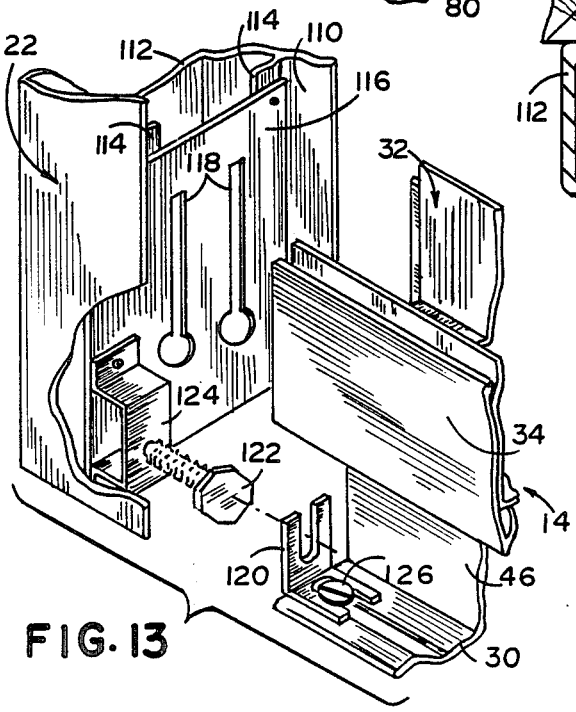
FIG. 13 is a fragmentary, perspective exploded view of the lower end of the door jam-floor leveler assembly, taken in the region of arrow XIII of FIG. 11.
Figure 14:
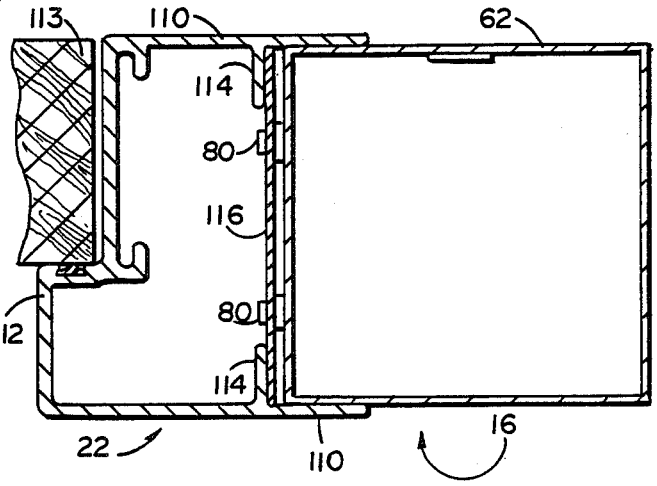
FIG. 14 is a fragmentary, top plan view of an assembled door jam-vertical stud assembly, taken along plane XIV—XIV of FIG. 11 when the wall system is in assembled condition.

Door jams 22 are mounted as shown in FIG. 11. Each door jam 22 is an extruded aluminum beam having sidewalls 110 that are joined by a configured face 112 (FIGS. 12–14). Configured face 112 is configured to accommodate hinges for mounting a door 113 on one side and a conventional door latch on the other. Converging inwardly from sidewalls 110 are mounting flanges 114. A series of rectangular mounting plates 116 are tack welded or otherwise suitably connected to mounting flanges 114. Mounting plates 116 are spaced along door jams 22 in order to lie adjacent shoulder screws 80 that project from the sides of base section 62. Each mounting plate 116 includes two elongated keyhole slots 118. Keyhole slots 118 receive shoulder screws 80 and tightly secure door jam 22 to the lower section 62 of a stud 16. As shown in FIG. 14, sidewalls 110 project past mounting flanges 114 and mounting plates 116 in order to form a stud receiving pocket in which lower section 62 of stud 16 is seated. As shown in FIG. 13, the base of each door jam 22 is secured to floor runner 30 in order to prevent door jam 22 from being accidentally raised up off of its supporting stud 16. An L-shaped securing bracket 120 is slotted in both legs in order to receive a locking bolt 122 that is threaded into a bracket 124 at the base of door jam 22. Slotted securing bracket 120 is clamped onto floor runner 30 by a bolt 126. Slotted securing bracket 120 provides adjustment between door jam 22 and floor runner 30 and thus accommodates variations in floor height and the like.

A header 130 (FIG. 12) is secured between the upper ends of door jams 22. Header 130 is an extruded beam having ends configured to abuttingly mate with configured faces 112 of door jams 22. Header 130 has a lower surface 132 to which a hanging bracket 134 is tack welded at either end. Hanging brackets 134 each include a horizontally bent end 136 that rests on the upper surface of door jam 22 in order to support header 130 while it is being secured to door jam 22. Each hanging bracket 134 includes a pair of apertures 138 that receive suitable conventional fasteners that rigidly secure header 130 to door jam 22.

Header 130 includes a pair of inwardly converging ledges 140 that each terminate in an upstanding flange 142. Ledges 140 and flanges 142 form seats for a pair of header wall panels (not shown) that are seated on top of ledges 140. The header wall panels are mounted in the same fashion as wall panels 20, described below, or may alternatively be secured above header 130 using conventional fasteners. Upstanding flanges 142 prevent the bottom edges of the header wall panels from sliding off the back of ledges 140.

Figure 15:
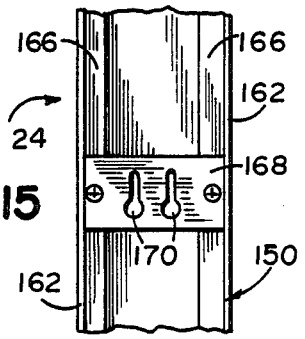
FIG. 15 is a fragmentary, side elevational view of a window frame used in the system of FIG. 1.
Figure 16:
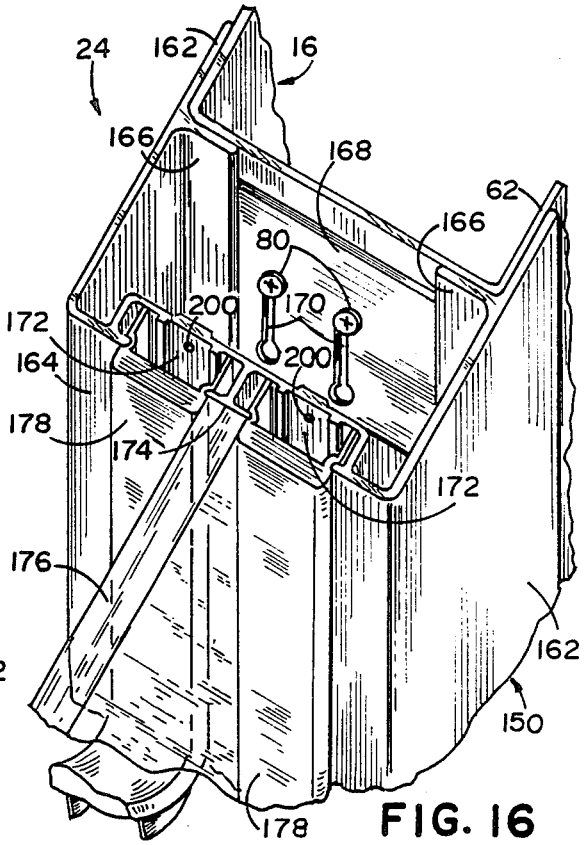
FIG. 16 is a fragmentary, perspective view of the window frame used in the wall system of FIG. 1, shown assembled onto a vertical stud.
Figure 17:
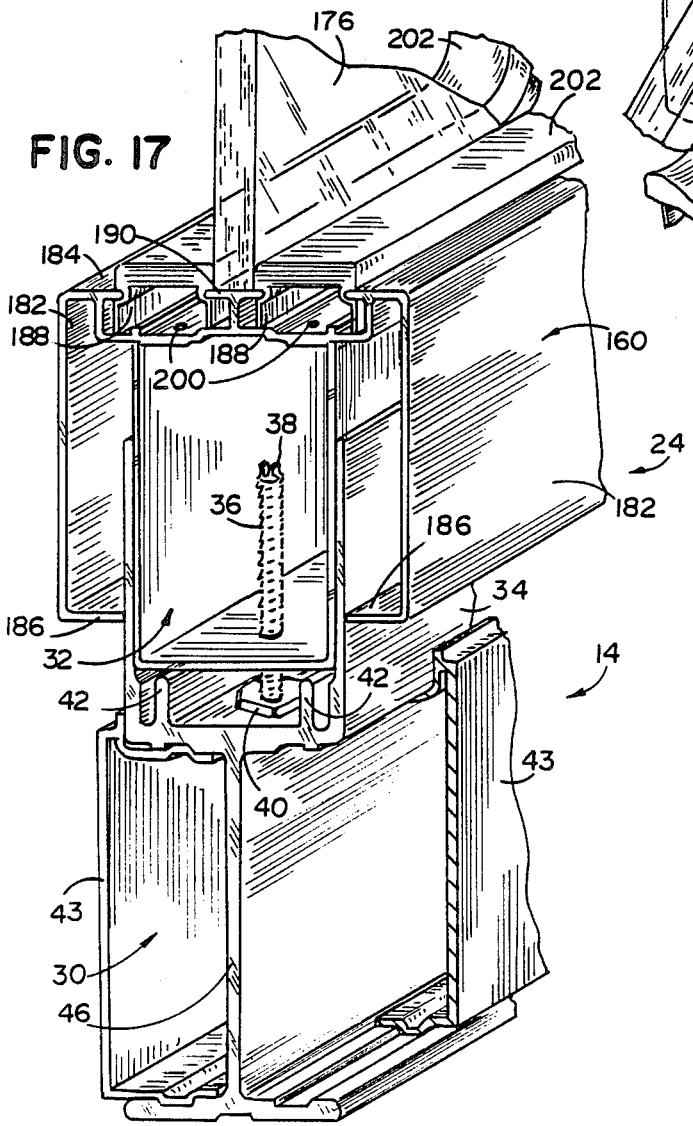
FIG. 17 is a fragmentary, perspective view of a window frame of the system shown in FIG. 1, shown assembled onto a floor leveler assembly.

Window frames 24 are also mounted on telescoping studs 16 using shoulder screws 80 (FIG. 16). Each window frame 24 includes two side frames 150 (FIGS. 15, 16) and two horizontal frames 160 (FIG. 17). Side frames 150 are similar to door jams 22 in that each side frame 150 includes sidewalls 162 joined by a configured face 164. Converging from the inside of sidewalls 162 are a pair of mounting flanges 166, to which are secured a series of mounting plates 168. Mounting plates 168 are spaced along side frames 150 in order to lie adjacent shoulder screws 80. Each mounting plate 168 includes two keyway slots 170 that are positioned to receive shoulder screws 80 and thereby support side frames 150. Sidewalls 162 are combined with mounting flanges 166 and mounting plates 168 to form seating pockets in which stud lower section 62 is snugly received.

On configured face 164 are two glaze receiving channels 172. Glaze channels 172 are spaced to extend immediately adjacent a T-shaped seating surface 174. A glass or transparent plastic pane 176 is seated against seating surface 174, and a pair of rubber or other elastomeric glazing strips 178 are pressed into glaze channels 172. Glazing strips 178 have an enlarged head that is tightly pressed against pane 176 in order to hold window pane 176 in position.

Horizontal frames 160 (FIG. 17) include sidewalls 182 joined by a configured face 184. Horizontal frames 160 have an open end opposite configured face 184, with inwardly extending flanges 186 projecting along the free edge of sidewalls 182. The lower horizontal frame 160 is slidably received over the top of floor leveler assembly 14, as shown in FIG. 17. Floor leveler upper channel 34 is received between flanges 186 on horizontal frame 160. The ends of horizontal frame 160 are secured to the bottom of side frames 150 by L-shaped straps or bands (not shown) that are screwed or otherwise suitably secured to side frame 150 and horizontal frame 160. Configured face 184 has the same configuration as configured face 164 and therefore includes glaze channels 188 and a T-shaped seating surface 190. The L-shaped joining straps are secured between side frames 150 and horizontal frames 160 by screws that are received through apertures 200 in the end of each glaze channel 172 and 188, the fastener passing through the joining bracket. Glazing strips 202 are pressed into glaze channels 188 on either side of pane 176.

Horizontal frame 160 slides over the top of floor leveler assembly 14 and therefore accommodates any variation in height of leveler bracket 32. The upper horizontal frame 160 is identical to lower horizontal frame 160 shown in FIG. 17, with the exception that the upper horizontal 160 is received over ceiling channel 12. When horizontal frames 160 are joined to side frames 150, window frame 24 is supported on shoulder screws 80 of stud lower section 62. In the assembly of window frame 24, side frames 150 and horizontal frames 160 are first mounted on telescoping studs 16, and one set of glazing strips 178, 202 are inserted for one side of pane 176. Pane 176 is then slid into window frame 24 and pressed against the previously positioned 30 glazing strips 178, 202, and thereafter the glazing strips 178, 202 for the opposite side of pane 176 are pressed into place.

Figure 18:
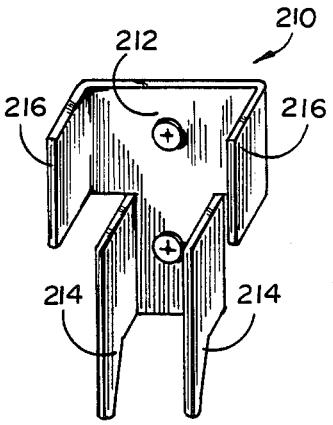
FIG. 18 is a perspective view of a mounting bracket for wall panels of the system shown in FIG. 1.

After the remainder of wall system 10 has been assembled, wall panels 20 are hung on horizontal stringers 18, as shown in FIG. 1. Mounting hooks 210 (FIG. 18) are fastened to the reverse side of panels 20 by screws or other suitable fasteners. Each hook 210 includes a backing plate 212 from which project two depending prongs 214. A pair of side flanges 216 also extend from back plate 212 above prongs 214. Prongs 214 angle downwardly away from back plate 212 in order to hook over the sidewalls of horizontal stringers 18 and draw wall panel 20 tightly against stringers 18 and telescoping studs 16. If desired, insulation panels 220 (FIG. 1) may be seated in horizontal stringers 18 after wall panels 20 have been hung on one side of wall assembly 10. Insulation 220 may provide both sound and temperature insulation for the work area enclosed by wall system 10.

Wall panels 20 have a standard width and are hung on stringers 18 to provide a narrow gap 230 (FIG. 19) at the location of each stud 16. Gaps 230 expose slots 64 on stud lower section 62 in order to provide for the hanging of wall accessories on wall system 10. Gaps 230 are most preferably in the range of one eighth inch thick to expose a minimal amount of vertical studs 16. As shown in FIG. 19, a series of adapter brackets 240 are used to hang a variety of wall accessories 242. Wall accessories 242 (shown in phantom) may be cupboards, shelves, tables, file dividers or other conventional wall accessories. Shown in FIGS. 20–27 are adapter brackets 240. Adapter brackets 240 are used to accommodate a variety of wall accessories 242 manufactured by different companies. Different manufacturers of wall accessories 242 provide hanging brackets on the rear of the wall accessory having differing spacings or configurations of hooks or hanging projections. Adapter brackets 240 are provided with accessory mounting apertures 244 of different spacings and configurations that mate with accessory hooks of different manufacturers.

As shown in FIGS. 20–22, a two-sided adapter bracket 240 includes a hook element 250. A hollow, rectangular mounting flange 252 with a forwardly facing front surface 262 extends to both sides of a single thickness hook element 250. Hook element 250 includes an upper projecting hook 254 (FIG. 22) and a downwardly depending hook 256. Hooks 254 and 256 are spaced in order to mate with slots 64 on stud lower section 62. Upper hook 254 is first inserted into one slot 64 and raised until lower hook 256 is received in another slot 64. A downwardly opening notch 257 on the undersurface hooks onto the lower edge of the mating slot in gap 230. As shown in FIG. 23, hook element 250 has alternating tabs 258 that are bent to the side of hook element 250. Tabs 258 are welded to the closed rear surface 260 of hollow, box-like mounting flange 252. As shown in FIGS. 20 and 21, accessory mounting apertures 244 open through a forward face 262 of hollow, box-like mounting flange 252. As shown in FIG. 20, accessory mounting apertures 244 are spaced close to the line of hook element 250 and are tightly vertically arrayed. In FIG. 21, mounting apertures 244 are spaced further from the line of hook element 250 and are spread wider in a vertical array. Each adapter bracket 240 is provided with a mounting aperture pattern that accommodates the hook pattern of a given wall accessory manufacturer. In order to mount wall accessory 242, after the hook pattern of accessory 242 is ascertained, a set of adapter brackets 240 is chosen having a complementary mounting aperture 244 pattern. Adapter brackets 240 are mounted on stud lower sections 62 and accessory 242 is hung on adapter brackets 240. The single thickness construction of hook element 250 permits mounting flange 252 to have sufficient strength to support two wall accessories, but hook element 250 has a narrow thickness so that the wall hanging slots may be narrowed.

Shown in FIGS. 24–27 are single-sided adapter brackets. Single-sided adapter brackets 240 are used when an accessory is to be mounted so as to extend only to one side of gap 230. Single-sided adapter brackets 240 also include a hook element 270 with a hollow box-like mounting flange 272 that extends to one side of hook element 250. Hook element 270 includes an upward hook 274, a downward hook 276, and a downwardly opening notch 277. A single tab 278 extends to one side of hook element 250. Tab 278 is provided with welding slots 279 that permit a weld to be made between tab 278 and a rear surface 280 on mounting flange 272. As shown in FIGS. 24 and 25, the spacing of mounting apertures 244 on forward face 282 may be varied in order to accommodate different accessory hook patterns.

It is to be understood that the above is a description of the preferred embodiments and that one skilled in the art will recognize that various modifications or improvements may be made without departing from the spirit of the invention disclosed herein. The scope of protection afforded is to be determined by the claims which follow and the breadth of interpretation that the law allows.

The embodiments of the invention in which an exclusive property or privilege is claimed are defined as follows:

1. A floor-to-ceiling wall assembly for use in a room having a floor surface and a ceiling comprising:

a ceiling channel comprising a pair of spaced, downwardly depending sidewalls joined by a top wall adapted to be secured to the ceiling, a pair of upper lips projecting inwardly from said sidewalls of said channel at a point spaced below said channel top wall and above the bottom edges of said sidewalls;

a floor runner having means for receiving the lower ends of vertical studs and holding same in a fixed position;

a plurality of generally vertically telescoping studs each having a lower portion and a mating upper portion, said telescoping studs having lower ends seated on said floor runner and upper ends slidably received in and suspended by said ceiling channel, said upper ends of each of said telescoping studs including at least semi-resiliently deformable lateral projections which are adapted to semi-resiliently deform and seat on top of said upper lips as said upper portion is raised to thereby snap over said upper lips and suspend said upper portion of said stud from said ceiling channel;

means for securing said studs against lateral movement in said ceiling channel;

a plurality of stringers extending between said lower portions of said studs, said studs and stringers including matingly and releasably engaging securing means whereby a stud seated in said floor runner can be laterally adjusted at its top until vertically oriented and then secured, and the remainder of said studs aligned by positioning said stringers between adjacent studs.

2. The wall system of claim 1 in which said matingly and releasably engaging securing means between said studs and said stringers comprise projections on said studs which include shoulder portions located at a point spaced from said studs, and keyhole slots on the ends of said stringers, said keyhole slots including an enlarged opening at one end thereof; said stringers including a bottom wall, spaced sidewalls and an end wall; said keyhole slots being located in said end walls of said stringers with said enlarged opening through said bottom walls whereby said stringers can be slipped down over said projections with said shoulders passing upwardly through said bottom openings of said keyhole slots and snapped into position behind said end walls of said stringer.

3. The wall system of claim 1, in which said telescoping vertical studs have hanging apertures therein;

a compressible blocking element extending within each said telescoping vertical stud.

4. The wall assembly of claim 1, in which said telescoping stud lower portions have slots therein, said slots spaced and adapted for hanging wall accessories thereon.

5. A floor-to-ceiling wall system comprising:

a plurality of vertical studs, each including a plurality of sets of projections projecting laterally from either side thereof, said projections including enlarged shoulders thereon at a point spaced from said studs;

a plurality of horizontal stringers extending between said studs for spacing said studs, each of said stringers including an end wall having a plurality of keyhole slots therein spaced to mate with said projections of one set of said projections and each said slot having an enlarged opening at one end to fit over said projecting shoulder portion of said projections whereby when said stringer is shifted into position said projecting shoulder portions will fit behind said end wall of said stringer and hold said stringer in place.

6. A floor-to-ceiling wall system comprising:

a plurality of vertical studs, each including a plurality of projections projecting laterally from either side thereof, said projections including enlarged shoulders thereon at a point spaced from said studs;

a plurality of horizontal stringers extending between said studs for spacing said studs, each of said stringers including an end wall having a keyhole slot therein with an enlarged opening at one end of said slot to fit over said projecting shoulder portion of said projections whereby when said stringer is shifted into position said projecting shoulder portions will fit behind said end wall of said stringer and hold said stringer in place;

a pair of door jams for mounting between adjacent studs;

each of said door jams including a plurality of keyhole slots for mating with said projections on said studs to thereby securely mount said door jams to said studs.

7. The wall system of claim 6 which includes a window frame comprising spaced vertical members, each of said vertical members including keyhole slots for mating with and mounting on said projections on said studs whereby said vertical members are securely mounted to spaced, adjacent vertical studs.

8. The wall system of claim 7 in which said stringers include a bottom wall extending between said end walls, said enlarged portion of said keyhole slots opening through said bottom wall of said stringer whereby said stringer can be slipped down and snapped over said projections on said vertical studs.

9. A floor-to-ceiling wall system comprising:

a plurality of vertical studs, each including a plurality of projections projecting laterally from either side thereof, said projections including enlarged shoulders thereon at a point spaced from said studs;

a plurality of horizontal stringers extending between said studs for spacing said studs, each of said stringers including an end wall having a keyhole slot therein with an enlarged opening at one end of said slot to fit over said projecting shoulder portion of said projections whereby when said stringer is shifted into position said projecting shoulder portions will fit behind said end wall of said stringer and hold said stringer in place;

a window frame comprising spaced vertical members, each of said vertical members including keyhole slots for mating with and mounting on said projections on said studs whereby said vertical members are securely mounted to spaced, adjacent vertical studs.

10. The wall system of claim 5 in which said stringers include a bottom wall extending between said end walls, said enlarged portion of said keyhole slots opening through said bottom wall of said stringer whereby said stringer can be slipped down and snapped over said projections on said vertical studs.

11. A floor-to-ceiling wall assembly for use in a room having a floor surface, a ceiling and a wall, comprising:

a ceiling channel adapted to be secured to the ceiling;

a floor leveler assembly comprising a floor runner adapted to be supported by the floor surface and having an upwardly opening channel, an elongated leveler bracket received in said floor runner channel and having upwardly opening stud seats thereon, and means for adjusting the horizontal level of said leveler bracket relative to said floor runner channel;

a plurality of generally vertically telescoping studs each having a lower portion and a mating upper portion, said telescoping studs having lower ends seated in said leveler bracket stud seats and upper ends seated by said ceiling channel;

a plurality of wall panels mounted on the assembly of said ceiling channel, said floor leveler assembly and said telescoping studs, whereby the adjustment of said floor leveler assembly simultaneously levels said telescoping studs and said telescoping stud upper portions accommodate the adjustment thereof.

12. The wall assembly of claim 11, further comprising:

a plurality of stringers secured between adjacent ones of said telescoping studs, said wall panels hung from said stringers.

13. The wall assembly of claim 12, wherein:

said stringers are secured to said telescoping studs lower portions.

14. The wall assembly of claim 12, wherein:

said telescoping studs' upper ends are hung from said ceiling bracket.

15. The wall assembly of claim 14, further comprising:

a set screw located between each said telescoping stud lower portion and said upper portion, said set screw selectively clamping said lower portion to said upper portion.

16. The wall assembly of claim 11 wherein:

said telescoping studs upper portions have upper ends resiliently compressing against said ceiling bracket; and means selectively securing said telescoping studs upper portions from retracting relative said lower portions.

17. A floor-to-ceiling wall assembly for use in a room having a floor surface, a ceiling and a wall, comprising:

a ceiling channel adapted to be secured to the ceiling;

a floor leveler assembly comprising a floor runner having an upwardly opening channel raised above the floor surface, an elongated leveler bracket received in said floor runner channel and having upwardly opening stud seats thereon, and means for adjusting the horizontal level of said leveler channel relative to said floor runner;

a plurality of generally vertically telescoping studs each having a lower portion and a mating upper portion, said telescoping studs having lower ends seated in said leveler channel stud seats and upper ends seated by said ceiling channel;

a plurality of stringers secured between adjacent ones of said telescoping studs;

a plurality of wall panels mounted on the assembly of said ceiling channel, said floor leveler assembly and said telescoping studs, said wall panels hung from said stringers;

a pair of door jams mounted between adjacent ones of said telescoping studs;

a window frame mounted between adjacent ones of said telescoping studs;

said telescoping studs each having at least one mounting projection thereon;

said stringers, said door jam and said window frame each having key ways thereon, said key ways receiving said telescoping studs projections to mount said stringers, said door jam and said window frame, whereby the adjustment of said floor leveler assembly simultaneously levels said telescoping studs and said telescoping stud upper portions accommodate the adjustment thereof.

18. The wall assembly of claim 17, wherein:

said window frame includes two sides, a bottom and a top;

said window frame sides are mounted to said telescoping studs, said window frame bottom includes a channel in which said floor leveler assembly is received, and said window frame top includes a channel in which said ceiling channel is received.

19. The wall assembly of claim 11, further comprising:

a plurality of sets of adapter mounting brackets interchangeably mounted on said telescoping studs, each said adapter mounting bracket having a plurality of accessory apertures thereon, and each set of adapter mounting brackets having different predetermined spacings of said accessory apertures adapted for the mounting receipt of accessory mounting hooks having different spacings.

20. The wall assembly of claim 11, wherein:

said telescoping studs include a plurality of slots therein;

a compressible rod within each of said telescoping studs.

* * * * *